United States Patent [19]

Brandley

[11] 4,353,666

[45] Oct. 12, 1982

[54] DEVICE FOR TRANSFERRING LOADS BETWEEN ADJOINING CONCRETE SLABS

[76] Inventor: Reinard W. Brandley, 3855 Oak Vista Way, Loomis, Calif. 95650

[21] Appl. No.: 214,114

[22] Filed: Dec. 8, 1980

[51] Int. Cl.[3] ..... E01C 11/14

[52] U.S. Cl. ..... 404/60; 404/74; 404/75; 404/88

[58] Field of Search ..... 404/88, 87, 75, 78, 404/62, 63, 60, 58, 68, 74; 52/396

[56] References Cited

U.S. PATENT DOCUMENTS

| | | | |
|---|---|---|---|
| 1,445,229 | 2/1923 | Miller | 404/56 |
| 1,639,763 | 8/1927 | Fischer | 404/56 |
| 1,915,032 | 6/1933 | Poulter | 404/78 |
| 2,158,953 | 5/1939 | Wilcox | 404/60 |
| 2,189,156 | 2/1940 | Willard | 404/59 |
| 2,194,718 | 3/1940 | Older | 404/60 |
| 2,291,109 | 7/1942 | Sensibar | 404/60 |
| 2,323,026 | 6/1943 | Geyer | 404/62 X |
| 2,419,022 | 4/1947 | Heztzel | 404/59 |
| 2,448,134 | 8/1948 | Abez | 404/63 |
| 4,191,489 | 3/1980 | Ray | 404/74 X |

*Primary Examiner*—Nile C. Byers, Jr.

*Attorney, Agent, or Firm*—Lothrop & West

[57] ABSTRACT

A first elongated steel frame has a dowel mounted thereon at right angles. The dowel projects through an aperture in a compressible filler board thence through a registering opening in a second elongated steel frame. The long dimensions of the two frames are parallel and each frame abuts an opposite surface of the filler board. A cap-like shield covers the free end of the dowel with end clearance to accommodate longitudinal thermal expansion and contraction. The two steel frames are free to move toward and away from each other but are constrained to move in unison in a direction perpendicular to the dowel. By bonding each frame to a respective concrete slab of a pair of adjoining slabs with the filler board co-planar with the joint, the slabs partake of the same freedom of motion in one direction and the same restraint in the other two directions.

10 Claims, 5 Drawing Figures

DEVICE FOR TRANSFERRING LOADS BETWEEN ADJOINING CONCRETE SLABS

CROSS-REFERENCES TO RELATED APPLICATIONS

None.

BACKGROUND OF THE INVENTION

Adjoining concrete slabs in highways, aircraft runways, warehouses, or the like, are repeatedly subjected to heavy wheel-borne loads which tend to deflect downwardly first one and then the other of the slabs as the wheel passes over the joint separating the two. As a result, vertical relative motion occurs along the slip plane of the joint.

One consequence of this relative motion is the "pumping" action produced by the slab as it first tilts up and then down. If the ground underlying the slab becomes muddy, the pumping action forces mud upwardly through openings in the joint, thereby depleting the material of the supporting ground surface and, in many cases, causing the appearance of voids, or cavities, under the slab. It is then only a matter of time until the repeated unsupported stresses cause small fractures to appear, followed by more serious ruptures which eventually compel major repairs, or even replacement, accompanied by costly and inconvenient down-time.

Numerous attempts have been made to circumvent the problem. For the most part, the efforts have been in the direction of providing a strong physical link, such as a dowel, embedded in the concrete in such a way as to span both of the adjoining slabs. Dowels are generally installed at the time of construction, as in Older U.S. Pat. No. 2,194,718 for Concrete Road Joint, and if properly installed they perform well.

If adequate load transfer is not provided for in the joints at the time of construction, it has heretofore been difficult, if not impossible, to install adequate load transfer in existing slab joints. The generally accepted method of installing load transfer devices in existing concrete slab joints has been to cut slots or trenches in the existing concrete across the joint and to install dowels in these slots and cement them in place.

This method of dowel installation in finish concrete can create inordinate stress concentrations in existing concrete slabs which can seriously damage the slabs and is expensive if the dowels are installed properly. If the dowels are not installed properly, then the condition created is worse than if the dowels were never installed.

Where slab rehabilitation is required, the cost and effort of excavating a hole large enough to accommodate a device such as that disclosed in the patent to Older would be economically unfeasible, particularly where the rehabilitation of major sections of highway or large aircraft runways or warehouses, for example, entails the use of hundreds of such devices.

Furthermore, as indicated above, the excavation in existing slabs required to install these devices damages the slabs, causing stress concentrations which can lead to extensive slab damage and ultimately to complete failure.

The load transfer device embodying the present invention, on the other hand, is easy to install and does not create stress concentrations in the existing slabs since it is placed in a round hole and adequately transfers load from one slab to another.

SUMMARY OF THE INVENTION

The invention relates generally to devices for transferring loads between adjoining concrete slabs and, more particularly, to dowel-type load transfer devices which can, if desired, be installed at the time the slabs are poured, but which can be used to especial advantage after the concrete has hardened and been subjected to use making rehabilitation imperative.

A first vertically elongated steel frame to which a dowel is attached is bonded to one of two adjoining concrete slabs with the axis of the dowel parallel to the surface of the slab and perpendicular to the joint between the adjoining slabs. A second vertically elongated steel frame spaced from the first frame is bonded to the other slab with an opening accurately fitting over the adjacent end of the dowel. Thus, a load on either of the slabs is transferred without harmful stress concentrations from the concrete to one steel frame, then to the dowel and to the other steel frame, and then to the concrete of the adjoining slab.

It is an object of the invention to provide a load transfer device which can readily be installed in a vertical core hole, which is quickly and cheaply drilled, even in hardened concrete, as by a diamond drill core bit.

It is another object of the invention to provide a load transfer device which is fabricated from well-known materials using well-recognized manufacturing techniques.

It is still another object of the invention to provide a load transfer device which minimizes the effects of stress concentrations in adjoining slabs of concrete in the vicinity of the installed device.

It is a further object of the invention to provide a load transfer device which allows free movement parallel to the top surface of the slabs and which permits the slabs to move as a result of thermal expansion and contraction without inducing serious stresses in the concrete.

It is still a further object of the invention to provide a load transfer device in which the joint between the concrete slabs continues through the device, thereby maintaining the integrity of the joint throughout.

It is yet a further object of the invention to provide a load transfer device which can be installed with safety and dispatch by people who do not require extensive technical training.

It is another object of the device to provide a generally improved load transfer device.

Other objects, together with the foregoing, are attained in the embodiment described in the following description and illustrated in the accompanying drawing.

DETAILED DESCRIPTION OF PREFERRED EMBODIMENT

While the load transfer device of the invention is susceptible of numerous different physical embodiments, depending upon the environment and requirements of use, many hundreds of the herein shown and described embodiment have been made, installed and used and have performed in an eminently satisfactory manner.

Aircraft runways, warehouse floors and highways are frequently constructed using a plurality of discrete concrete slabs 11 separated by joints 12.

The surface dimensions and thickness of the slabs vary, depending upon the use to which they are to be subjected. Such matters are well known in the art and are therefore not discussed in any detail herein.

The load transfer device of the present invention can be utilized at the time of laying the slabs in new installations; however, one of its principal attributes is its adaptability for use in rehabilitating long established facilities in which hardened concrete slabs are in need of repair.

The device is elongated and lends itself to installation in a vertical attitude in a readily drilled core hole, as opposed to the traditional arrangement in which aligned horizontal trenches are formed in adjoining slabs, as by pneumatic hammers, followed by installing the dowel structure and then backfilling with concrete.

The following description therefore relates, for the most part, to the device as it is used in conjunction with the repair of existing hardened concrete slabs and for the prevention of future deterioration resulting from disabling stress concentrations.

Figure 1:
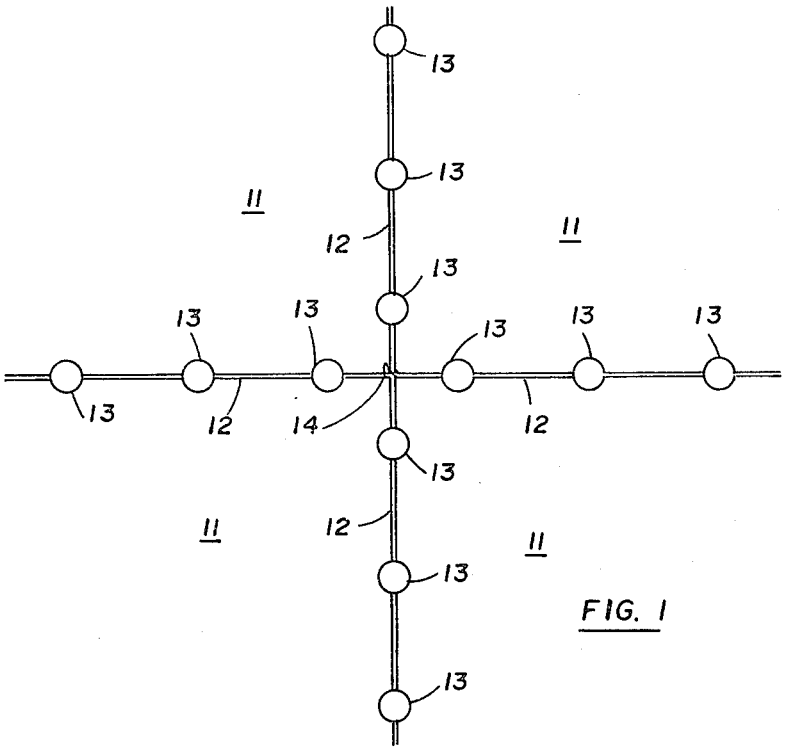
FIG. 1 is a fragmentary schematic diagram of a typical concrete slab layout at a four corner intersection showing a preferred arrangement of core holes prepared for installation of load transfer devices embodying the present invention, the width of the joint being exaggerated.
Figure 2:
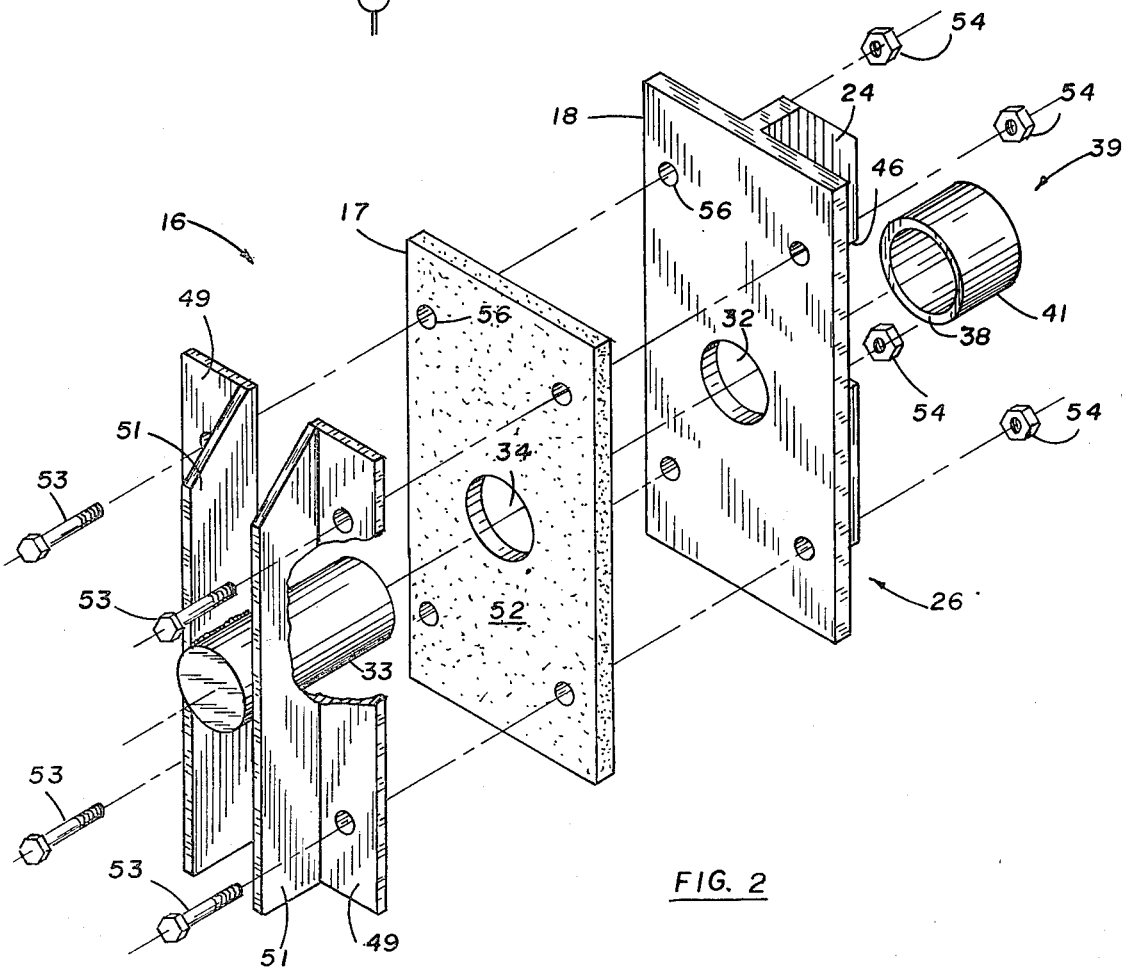
FIG. 2 is an exploded perspective view of the device.

It has been found that a good distribution of the circular in cross-section core holes 13, drilled by a diamond core bit, for example, is that shown in FIG. 1.

Assuming the core hole diameter to be six inches, the core holes 13 adjacent the four corner intersection 14 are located so that their vertical axes are about one foot from the intersection 14. The remaining core holes 13 are about two feet apart, center to center. The core holes are ordinarily drilled through the entire thickness of the slab.

The total height of the load transfer device of the invention, generally designated by the reference numeral 16, varies, depending upon slab thickness, but in general is equal to the thickness of the slab.

As previously indicated, voids or cavities are often formed underneath the slabs in the vicinity of the slab joints, the voids being caused by the slight rocking of the slab in response to load variations. As the slab tilts a mud "pumping" effect is created, the mud being formed where surface water trickles downwardly through gaps in the joint and meets the subjacent earth material.

To cure the situation, grout can be forced into the cavities located adjacent the slab joints. After the grout hardens, slab support is renewed and further "pumping" is defeated. However, cavities will reappear within a short period of time unless adequate load transfer is developed between the adjacent slabs. Slab grouting is conveniently accomplished in the following manner. Prior to drilling the six-inch diameter core holes 13 capable of receiving the load transfer device 16, several two-inch grout holes (not shown) are drilled with the axis of the two inch hole located in the joint, just as in the case of the six inch core hole. The two inch grout hole penetrates the slab clear to the bottom so that grout can be forced through the two inch hole and thus fill the underlying void. The two inch holes are located not more than four feet apart, center to center, and are positioned in precisely the same spatial arrangement as that indicated in FIG. 1 for the six inch core holes.

A slab rocking beam (not shown) is placed on each slab surrounding the joint voids to be grouted and grout is thereupon injected into one of the two inch holes until the grout emerges from an adjacent two inch hole. Care is exercised to make sure, by reference to the rocking beam, that excessive grout is not introduced, which might cause the slab to raise too much.

After the voids are filled with grout, the grid-work of six inch core holes are drilled and installation of the load transfer devices 16 is commenced.

Figure 3:
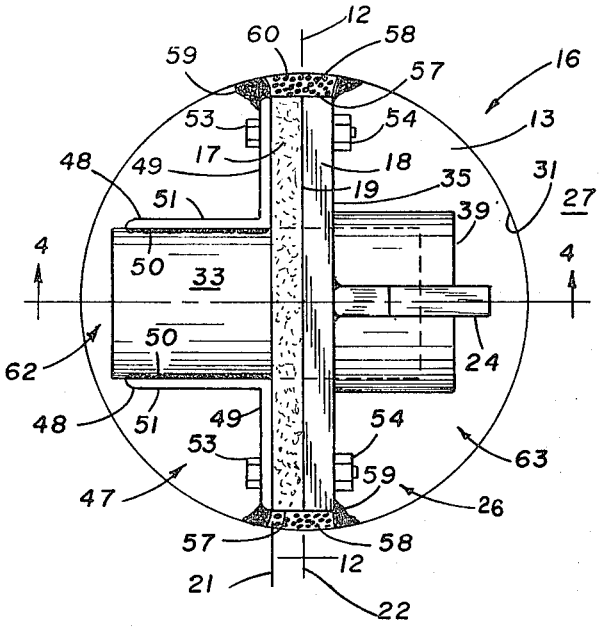
FIG. 3 is a top plan view showing the device installed in a core hole with the lateral edges sealed and prepared for cementing.

The device 16 is lowered into the core hole 13 and oriented so that a rectangular board 17 of premolded compressible filler material (such as styrofoam or equivalent) is aligned with the joint 12, as appears in FIG. 3.

This orientation will cause a vertical metal plate 18, substantially coextensive in size and in face to face engagement with one side 19 of the board 17, to be in parallel relation to the opposite faces 21 and 22 of the joint 12.

Serving to strengthen the plate 18 and provide additional surface area is a vertical stiffening rib 24 welded to the plate 18 at right angles, the rib 24 and plate 18 forming a frame, generally designated by the reference numeral 26.

Figure 4:
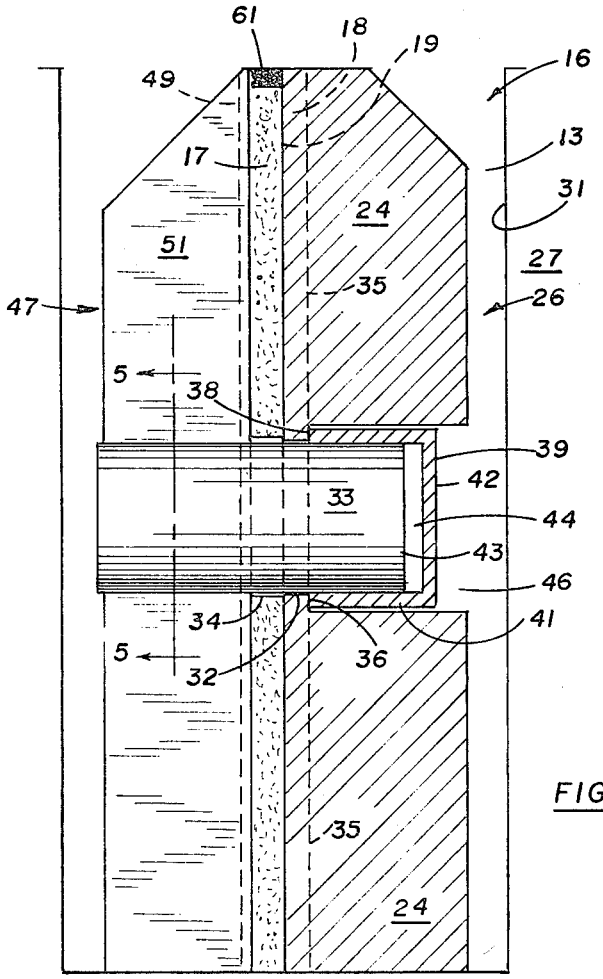
FIG. 4 is median, vertical, longitudinal, sectional view, the plane of the section being indicated by the line 4—4 in FIG. 3; and, FIG. 5 is a sectional view taken on the line 5—5 in FIG. 4.

The large surface area afforded by the frame 26 enables it to be bonded securely to the adjacent slab 27 (see FIGS. 3 and 4) when the core hole 13 is filled with a cementing material, such as polymer concrete, epoxy cement, or the like, which, when cured, has about the same coefficient of expansion, compressive and bonding strength as the concrete material of the slab.

It should be noted that the walls 31 of the core hole 13 should be sufficiently rough as to provide a good bond with the cementing material. In a similar fashion, the core hole 13 and all the steel surfaces of the device are to be free from oil, dust, paint, rust or other products which would detract from a tight bond.

Approximately at the center of the rectangular plate 18 is an opening 32 through which protrudes the adjacent end of a very strong dowel 33, about two inches in diameter in the present embodiment. A very close tolerance between the dowel 33 and the encompassing walls of the opening 32 is important, e.g. no more than 0.015 inch. A coaxial aperture 34 of about the same diameter as the opening 32 is formed in the filler board 17. The dowel 33 extends through the aperture 34 and the opening 32 and projects beyond the nether surface 35 of the plate 18. Firmly abutting the annular shoulder portion 36 of the surface 35 is the rim 38 of a cup-shaped dowel cap 39 which fits on the end of the dowel 33 with a very small tolerance in order effectively to shield the enclosed end of the dowel from the cementing material which is finally poured into the hole 13 to complete the installation. The dowel cap 39 is of sturdy "plastic" material and includes side walls 41 and an end closure 42 or cup "bottom".

The adjacent end 43 of the dowel 33 is spaced from the cap closure 42 to provide freedom of movement for the dowel as thermal expansion and contraction occur. The space 44 can be on the order of $\frac{1}{4}''$ to $\frac{3}{4}''$, or so.

In order to accommodate the dowel cap 39, the vertical stiffening rib 24 is interrupted by a gap 46.

Figure 5:
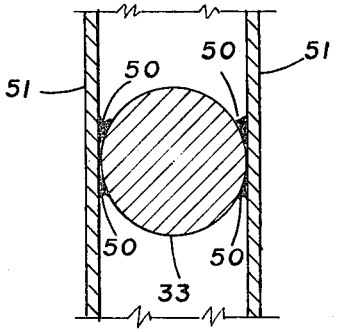

Another steel frame 47, also providing a large surface area to afford superior bonding, includes a pair of steel angles 48, or angle irons, each having a base flange 49 and a wing flange 51. The dowel 33 is firmly secured to the wing flanges by welds 50 (see FIGS. 3 and 5).

The base flanges 49 abut the adjacent side face 52 of the filler board 17 and are temporarily secured thereto by a plurality of readily ruptured fasteners, such as thin bolts 53 and nuts 54.

The bolts 53 extend through respective small apertures 56 passing through the base flanges 49, the filler board 17 and beyond the plate 18 where they are secured by the nuts 54. The fasteners 53 and 54 serve only to position the components for the purpose of installing the load transfer device in the core hole, sealing the lateral ends and pouring the cementing material in the opposite sides of the hole.

Once the device becomes operative, after the cementing material cures and hardens, thermal expansion and contraction as well as the slight relative vertical motion between the adjoining slabs permitted by the device will rupture the weak fasteners 53 and 54 as if they were not even present.

As appears most clearly in FIG. 3, the two lateral ends 57 are spaced a short distance from the adjacent core hole walls 31. This void is filled with compressible filler material 60, for example, styrofoam beads $\frac{1}{8}''$ to $\frac{1}{4}''$ in diameter. The filler material 60 extends upwardly to within $\frac{1}{2}''$ of the top surface of the slabs.

Along the two opposite margins of each of the voids 58 is a bead 59 of a mastic bond extending the full vertical length of the device. This mastic bond not only secures the load transfer device to the core hole walls as the cementing material is introduced, but, in conjunction with the styrofoam beads 60, prevents any of the cementing material from flowing around the lateral ends 57 of the board filler 17 and the plate 18 to interfere in any way with the operation of the filler in the joint 12 or the proper functioning of the device as a whole. In the sequence of installation of the device, the mastic 59 is installed first, followed by introduction of the styrofoam beads 60, the mastic serving to hold the beads in place.

For still further assurance, the top $\frac{1}{2}''$ or so of the premolded compressible filler board 17 is sealed by a conventional joint sealant 61, such as asphalt or urethane.

With the device in vertical posture and aligned with the slab joint 12 and with the lateral ends prepared as described above, the cementing material is poured into the respective opposite "halves" 62 and 63 of the core hole 13, as indicated in FIG. 3, up to the top of the hole and allowed to cure.

After the cementing material has hardened and the device becomes operative, the left-hand frame 47, as viewed in FIG. 3, is free to move, relatively, toward and away from the right-hand frame 26, with the dowel 33 intruding into and retracting from the dowel cap 39. Relative vertical motion between the two frames, on the other hand, is virtually non-existent.

Thus, the respective adjacent half columns of cement and the slabs to which they are bonded are free to move toward and away from each other in response to temperature changes. At the same time, owing to the very large surface areas of the two frames, load forces are readily transferred from one slab to an adjacent slab.

I claim:

1. Device for transferring vehicle load between a pair of adjoining concrete slabs having a circular in cross-section core hole perpendicular to the slab surfaces and parallel to the joint faces with the core hole axis approximately midway between the joint faces, said device comprising:

a. a rectangular board of premolded compressible filler material positioned vertically substantially on a diameter of the core hole and parallel to the joint faces, said board having its long dimension extending substantially from the bottom of the core hole to the surfaces of the slabs and having a central aperture;

b. a metal plate substantially coextensive in size with said board, said plate covering one side of said board and having a central opening coaxial with said central aperture in said board;

c. a pair of metal angles arranged vertically on the other side of said board with respective flanges in opposed parallel relation and separated a predetermined distance;

d. a right circular cylindrical dowel having a diameter substantially equal to said predetermined distance, said dowel being secured to said flanges in horizontal attitude with one end portion extending through said opening and said aperture to project a given distance beyond said aperture, the axis of said dowel being coincident with the axis of said opening and said opening;

e. cap means covering said one end of said dowel for shielding the surface of said one end portion thereof.

2. A device as in claim 1 including a stiffening rib mounted vertically on the side of said plate opposite to said board, said rib being substantially the same height as said plate.

3. A device as in claim 2 in which the plane of said rib intersects the axis of said dowel and in which said rib is interrupted to accommodate said dowel.

4. A device as in claim 1 in which the lateral edges of said board and said plate are adjacent the walls of the core hole to facilitate sealing said lateral edges to said walls in order to isolate the portion of the hole containing said plate from the portion of the hole containing said angles.

5. A device as in claim 1 in which said cap means includes a cup of plastic material, the walls of said cup enclosing said one end portion of said dowel and the closed end of said cup being spaced from the adjacent end of said dowel a distance sufficient to accommodate said dowel as said dowel undergoes temperature expansion.

6. Device for transferring loads between adjoining concrete slabs having a circular in cross-section core hole perpendicular to the slab surfaces and parallel to the joint faces with the core axis approximately midway between the joint faces, said device comprising:

a. a first vertically elongated frame dimensioned to occupy the semi-circular in cross-section portion of the core hole formed in one of the slabs;

b. a second vertically elongated frame dimensioned to occupy the semi-circular in cross-section portion of the core hole formed in the other of the slabs;

c. a dowel mounted horizontally on said first frame and extending through a registering opening in said second frame;

d. a compressible filler interposed between said frames and positioned substantially in the plane of the slab joint; and, e. means for covering the portion of the dowel which extends beyond said registering opening to prevent bonding between said dowel and cementing material placed in the semi-circular in cross-section portion of the core hole formed in said other of the slabs.

7. A device as in claim 6 in which said covering means is spaced from said dowel to accommodate expansion and contraction movement between the slabs.

8. A device as in claim 6 in which said first vertically elongated frame includes a pair of vertical angles having base flanges abutting one side of said filler and wing flanges spaced apart to mount said dowel therebetween, said base flanges and said wing flanges extending substantially the height of the semi-circular in cross-section portion of the core hole formed in said one of the slabs and providing a large surface area for secure engagement with the cementing material placed therein.

9. A device as in claim 6 in which said second vertically elongated frame includes a vertical plate abutting the other side of said filler, and a stiffening rib mounted vertically on the side of said plate opposite said filler, said plate and said rib extending substantially the height of the semi-circular in cross-section portion of the core hole formed in said other of the slabs and providing a large surface area for secure engagement with the cementing material placed therein.

10. A device as in claim 6 in which the lateral vertical edges of said first and second frames are substantially coextensive with the lateral vertical edge of said filler and all of said lateral vertical edges are adjacent the vertical walls of the core hole to facilitate sealing said edges to said walls; and means for sealing said edges to said walls to isolate the portion of the hole containing said first frame from the portion of the hole containing said second frame.

* * * * *